US012601184B2

(12) United States Patent
Neill et al.

(10) Patent No.: US 12,601,184 B2
(45) Date of Patent: Apr. 14, 2026

(54) ARCHITECTURAL SIDING AND METHOD OF USE

(71) Applicant: R&L MARKETING & SALES, INC., Youngstown, OH (US)

(72) Inventors: David M. Neill, Canfield, OH (US); Tod Allen Newman, Girard, OH (US)

(73) Assignee: R&L MARKETING & SALES, INC., Youngstown, OH (US)

( * ) Notice: Subject to any disclaimer, the term of this patent is extended or adjusted under 35 U.S.C. 154(b) by 341 days.

(21) Appl. No.: 18/173,364

(22) Filed: Feb. 23, 2023

(65) Prior Publication Data

US 2024/0287815 A1 Aug. 29, 2024

(51) Int. Cl.
*E04F 13/08* (2006.01)
*E04F 13/18* (2006.01)

(52) U.S. Cl.
CPC ..... *E04F 13/0894* (2013.01); *E04F 13/18* (2013.01); *E04F 2201/0107* (2013.01); *E04F 2201/023* (2013.01); *E04F 2201/043* (2013.01)

(58) Field of Classification Search
CPC ..... E04F 13/0894; E04F 13/18; E04F 2201/0107; E04F 2201/023; E04F 2201/043; E04F 13/0864
See application file for complete search history.

(56) References Cited

U.S. PATENT DOCUMENTS 4,274,236 A 6/1981 Kessler
4,288,958 A 9/1981 Chalmers et al.
4,292,781 A 10/1981 Chalmers et al.
4,461,128 A 7/1984 Knoebl
4,476,661 A 10/1984 Hoofe, III
4,669,238 A 6/1987 Kellis et al.
4,712,351 A 12/1987 Kasprzak
4,782,638 A 11/1988 Hovind
4,864,788 A 9/1989 Tippmann
4,932,453 A 6/1990 Hoover et al.
5,042,199 A 8/1991 Schneider et al.
5,314,325 A 5/1994 Bosler
5,363,623 A 11/1994 King
5,371,990 A 12/1994 Salahuddin
5,465,486 A 11/1995 King
5,505,031 A 4/1996 Heydon
5,537,792 A 7/1996 Moliere
5,579,617 A 12/1996 Schiedegger et al.
5,651,227 A 7/1997 Anderson
5,697,196 A 12/1997 Salahuddin
5,806,185 A 9/1998 King
5,822,931 A 10/1998 Galowitz et al.
5,850,717 A 12/1998 Schiedegger et al.
(Continued)

*Primary Examiner* — Babajide A Demuren

(74) *Attorney, Agent, or Firm* — Sand, Sebolt & Wernow Co., LPA

(57) ABSTRACT

A siding product has a downwardly opened connector near an upper portion of a frontal face. There is a channel below the downwardly opened connector. The siding product also has an upwardly opened connector near a lower portion of a rear face. There is a projection on the upwardly opened connector that interlocks or connects with the channel when the two connectors are connected together. The protrusion on one siding product and the channel on another siding product cooperate to prevent the top siding product from falling or distorting its shape prior to installation of the top siding piece on the structure.

20 Claims, 8 Drawing Sheets

(56) References Cited

U.S. PATENT DOCUMENTS 6,041,552 A 3/2000 Lindahl
6,073,404 A 6/2000 Norfleet
6,076,320 A 6/2000 Butler
6,122,877 A 9/2000 Hendrickson et al.
6,212,835 B1 4/2001 Schiedegger et al.
6,276,101 B1 8/2001 Schiedegger et al.
6,295,777 B1 10/2001 Hunter et al.
6,296,133 B1 10/2001 Cobane
6,298,626 B2 10/2001 Rudden
6,385,927 B2 5/2002 Schiedegger et al.
6,421,964 B1 7/2002 Schiedegger et al.
6,463,707 B1 10/2002 Schiedegger et al.
6,682,814 B2 1/2004 Hendrickson et al.
6,725,614 B2 4/2004 Schiedegger et al.
6,725,618 B2 4/2004 Albracht
6,782,666 B1 8/2004 Condon et al.
6,786,015 B2 9/2004 Wilt
6,880,304 B1 4/2005 Budge
7,028,440 B2 4/2006 Brisson
7,127,856 B2 10/2006 Hagen, Jr. et al.
7,168,216 B2 1/2007 Hagen, Jr.
7,228,663 B2 6/2007 Schiedegger et al.
7,240,461 B1 7/2007 Vandeman et al.
7,296,989 B2 11/2007 King
7,409,800 B2 8/2008 Budge
7,574,837 B2 8/2009 Hagen, Jr. et al.
7,600,356 B2 10/2009 Benjamin et al.
7,666,258 B2 2/2010 Guevara et al.
7,673,425 B2 3/2010 Thomas
7,685,787 B1 3/2010 Mollinger et al.
7,698,864 B2 4/2010 Justice et al.
7,698,865 B2 4/2010 Pringle et al.
7,698,867 B1 4/2010 Stucko et al.
7,739,807 B2 6/2010 Grant
7,743,564 B2 6/2010 Schiedegger et al.
7,775,008 B2 8/2010 King
7,790,302 B2 9/2010 Ladely (guevara) et al.
7,856,790 B2 12/2010 Jambois et al.
7,908,814 B2 3/2011 Wilson et al.
7,954,292 B2 6/2011 Holt et al.
7,964,272 B2 6/2011 Guevara et al.
7,980,037 B2 * 7/2011 Trabue ..... E04D 1/265 52/302.1
7,987,646 B2 8/2011 Race et al.
8,061,097 B2 11/2011 Holt et al.
8,117,801 B2 2/2012 Jambois et al.
8,201,372 B2 6/2012 Holt et al.
8,225,573 B2 7/2012 Wilson et al.
8,347,583 B2 1/2013 Cashman
8,407,954 B2 4/2013 Keith et al.
8,413,386 B2 4/2013 Fazekas
8,522,498 B2 9/2013 Picken
8,585,753 B2 11/2013 Scanlon et al.
8,601,754 B2 12/2013 Jenkins et al.
8,601,768 B2 12/2013 Cashman
8,621,812 B2 1/2014 Holt
8,631,614 B2 1/2014 Livsey et al.
8,646,228 B2 2/2014 Jenkins
8,677,702 B2 3/2014 Jenkins
8,748,855 B2 6/2014 Appleby et al.
8,800,217 B1 8/2014 Miller
8,950,128 B2 2/2015 Kalkanoglu et al.
8,959,848 B2 2/2015 Jenkins et al.
8,966,838 B2 3/2015 Jenkins
9,016,221 B2 4/2015 Brennan et al.
9,032,672 B2 5/2015 Livsey et al.
9,045,651 B2 6/2015 Chen et al.
9,091,049 B2 7/2015 Walker
9,115,491 B2 8/2015 Keith et al.
9,115,503 B2 8/2015 Ciuperca
9,166,087 B2 10/2015 Chihlas et al.
9,212,832 B2 12/2015 Jenkins
9,267,296 B2 2/2016 Maurer et al.
9,270,224 B2 2/2016 Livsey et al.
9,356,174 B2 5/2016 Duarte et al.
9,422,922 B2 8/2016 Sant'Anselmo et al.
9,574,341 B2 2/2017 Ciuperca
9,604,428 B2 3/2017 Walker
9,624,679 B2 4/2017 Ciuperca
9,755,573 B2 9/2017 Livsey et al.
9,804,607 B1 10/2017 Coleman
9,982,445 B2 5/2018 Ciuperca
10,153,094 B2 12/2018 Mehta et al.
10,167,629 B2 1/2019 Ciuperca
10,207,315 B2 2/2019 Appleby et al.
10,307,871 B2 6/2019 Coleman
10,401,876 B1 9/2019 Coleman
10,454,408 B2 10/2019 Livsey et al.
10,458,123 B2 10/2019 Culpepper et al.
10,550,578 B2 2/2020 O'Neal
10,550,579 B2 2/2020 O'Neal
10,557,271 B2 2/2020 Olvey et al.
10,612,245 B2 4/2020 Culpepper et al.
10,753,099 B2 8/2020 O'Neal
10,852,037 B2 12/2020 Sant'Anselmo et al.
10,858,839 B2 12/2020 Haynes et al.
10,934,719 B2 3/2021 Steffes et al.
11,018,618 B2 5/2021 Haynes et al.
11,025,192 B2 6/2021 Livsey et al.
11,092,977 B1 8/2021 Coleman
11,396,749 B2 7/2022 Smith et al.
2002/0098110 A1 7/2002 Graham et al.
2002/0129571 A1 9/2002 Jurvis et al.
2002/0129572 A1 9/2002 Jurvis et al.
2002/0178666 A1 12/2002 Jurvis et al.
2003/0029105 A1 2/2003 Jurvis
2004/0148879 A1 8/2004 Schiedegger et al.
2004/0148965 A1 8/2004 Hutchison et al.
2004/0159062 A1 8/2004 Donlin et al.
2005/0158116 A1 7/2005 Ferri et al.
2005/0281999 A1 12/2005 Hofmann et al.
2006/0012066 A1 1/2006 Hutchison et al.
2006/0213142 A1 9/2006 Albracht
2007/0011966 A1 1/2007 Justice et al.
2007/0078191 A1 4/2007 Guhde et al.
2007/0096505 A1 5/2007 Haack
2007/0107356 A1 5/2007 Steffes et al.
2007/0163187 A1 7/2007 Price
2007/0163188 A1 7/2007 Price
2007/0163203 A1 7/2007 Price
2007/0175114 A1 8/2007 Price
2007/0175115 A1 8/2007 Price
2007/0175150 A1 8/2007 Price
2007/0175154 A1 8/2007 Wilson et al.
2008/0098683 A1 * 5/2008 Trabue ..... E04D 1/265 52/520
2008/0107852 A1 5/2008 Rubb et al.
2008/0250739 A1 10/2008 Krupinski et al.
2009/0025334 A1 1/2009 Aquilina et al.
2009/0307994 A1 12/2009 Cathcart et al.
2009/0320400 A1 12/2009 Benjamin et al.
2010/0050556 A1 3/2010 Burns
2010/0132295 A1 6/2010 Bootier et al.
2010/0132296 A1 6/2010 Bootier et al.
2010/0236175 A1 9/2010 King
2010/0283190 A1 11/2010 King
2010/0325903 A1 12/2010 Patel
2010/0325983 A1 12/2010 Schiedegger et al.
2011/0214391 A1 9/2011 Guevara et al.
2012/0031023 A1 2/2012 Scalzi et al.
2012/0247049 A1 10/2012 Wagner et al.
2013/0067846 A1 3/2013 Kvols et al.
2014/0138014 A1 5/2014 Chaudhry et al.
2016/0135593 A1 5/2016 Delorean et al.
2016/0244972 A1 8/2016 Duarte et al.
2016/0278517 A1 9/2016 Delorean
2017/0182731 A1 6/2017 Walker
2017/0191257 A1 7/2017 Ciuperca
2018/0126688 A1 5/2018 Walker
2020/0032521 A1 1/2020 Culpepper et al.
2020/0232205 A1 7/2020 Richmond et al.
2021/0131172 A1 5/2021 Johnson
2021/0373582 A1 12/2021 Coleman
2022/0021329 A1 1/2022 Livsey et al.

(56) References Cited

U.S. PATENT DOCUMENTS

| | | | |
|---|---|---|---|
| 2022/0024180 | A1 | 1/2022 | Bartel et al. |
| 2022/0159220 | A1 | 5/2022 | Siminoff et al. |
| 2022/0162860 | A1 | 5/2022 | Sherman |
| 2022/0333378 | A1 | 10/2022 | Smith et al. |

* cited by examiner

ARCHITECTURAL SIDING AND METHOD OF USE

REFERENCE TO RELATED APPLICATIONS

This application claims the benefit of U.S. Provisional Application Ser. No. 63/484,341, filed on Feb. 10, 2023; the disclosure of which is incorporated herein by reference.

TECHNICAL FIELD

This disclosure is directed to a building or architectural product, and more particular a siding product for a structure, such as a vinyl siding product, panel or board that is to be arranged to form a siding assembly for the structure.

BACKGROUND ART

Overlapping exterior siding for houses or structures has been in use for many years. In the early days, such siding was formed of wood. However, wood must be painted at regular intervals for protection and in some instances, paint is ineffective in affording protection as when moisture is able to penetrate through the siding causing blistering and cracking of the paint as well as rotting of the wood.

Various replacement materials for wood in the fabrication of siding have been employed in attempts to retain a pleasing visual effect, while eliminating most of the disadvantages inherent in wood. Typical replacement materials for wood include metal, particularly aluminum, particularly painted aluminum. Other materials have included semi-hardboard, highly-sized insulation board, and other materials. Additionally, plastics and particularly vinyl plastics are commonly used as siding materials. Such plastics may be pigmented to provide desired colors, thereby eliminating the necessity for painting, they are low in cost, have good weather resistance, and do not rot or split. Plastic siding panels have been designed for use alone or with a rigid board-like material called backerboard which is generally formed of materials having insulating properties. Plastic siding panels have been desirably arranged in overlapping and interlocking relationship to provide a pleasing appearance, while concomitantly providing weather resistance and insulation.

SUMMARY OF THE INVENTION

The structure to effectuate the interlocking relationship between panels or boards in plastic siding heretofore lacks sufficient retention and alignment capabilities which may cause some panels or boards to fall, become disconnected and/or skewed prior to that board being connected to the structure. Therefore, what is needed is an improved configuration of a siding product that improves the interlockability between two panels, boards or siding products that prevents the board from falling or being misaligned prior to installing the board on the structure. The present disclosure addresses this need and other issues by providing the siding product detailed herein and an installation method thereof.

In one aspect, an exemplary embodiment of the present disclosure may provide a siding product comprising: a body having a first end and a second end defining a lateral direction therebetween, a top and a bottom defining a vertical direction therebetween, and a front and a rear defining a transverse direction therebetween; a front surface of the body and a rear surface of the body that is opposite front surface; a downwardly opened first connector on the front surface of the body; a channel formed in the front surface below the downwardly opened first connector, wherein the channel is elongated in the lateral direction between a first end of the channel and a second end of the channel; an upwardly opened second connector at or near the bottom of the rear surface, wherein the upwardly opened second connector includes a projection that is elongated in the lateral direction between a first end of the projection and a second end of the projection; wherein the projection on the upwardly opened second connector is configured to mate with the channel formed in the front surface of an identical second siding product when installed to form a siding assembly for a structure. This exemplary embodiment or another exemplary embodiment may further provide that upwardly opened second connector is J-shaped hook that comprises: a lower first leg having a first end and a second end, wherein the first end is coupled to the rear surface of the body; and a vertical second leg having a lower end and a terminal upper end, wherein the lower end is coupled with the second end of the lower first leg, and the vertical second leg having a front surface and a rear surface, wherein the projection projects rearward from the rear surface of the vertical second leg of the J-shaped hook. This exemplary embodiment or another exemplary embodiment may further provide that the projection on the J-shaped hook is closer to the lower end of the vertical second leg than the terminal upper end. This exemplary embodiment or another exemplary embodiment may further provide that the projection on the J-shaped hook includes an upper surface of the projection, a lower surface of the projection, and an intermediate surface of the projection that is aligned in the vertical direction and extends between the upper surface of the projection and the lower surface of the projection. This exemplary embodiment or another exemplary embodiment may further provide that the projection has a width dimension measured in the transverse direction from the intermediate surface of the projection to the rear surface of the vertical second leg of the J-shaped hook, and wherein the width dimension of the projection is approximately equal to a width dimension of the channel on the front surface of the body. This exemplary embodiment or another exemplary embodiment may further provide that the projection has a height dimension measured in the vertical direction from the lower surface of the projection to the upper surface of the projection, and wherein the height dimension of the projection is less than a height dimension of the channel on the front surface of the body. This exemplary embodiment or another exemplary embodiment may further provide that the projection further includes: a first rounded corner between the upper surface of the projection and the intermediate surface of the projection, wherein the first rounded corner has a first radius of curvature, and the first rounded corner is adapted assist with the connection and disconnection of the siding project to the channel in the front surface of the identical second siding product. This exemplary embodiment or another exemplary embodiment may further provide that the projection further includes: a second rounded corner between the lower surface of the projection and intermediate surface of the projection, wherein the second rounded corner has a second radius of curvature, and the second rounded corner is adapted assist with the connection and disconnection of the siding project to the channel in the front surface of the identical second siding product. This exemplary embodiment or another exemplary embodiment may further provide that the first radius of curvature is equal to the second radius of curvature. This exemplary embodiment or another exemplary embodiment may further provide that the first radius of curvature is different than the second radius of curvature. This exemplary embodiment or another exemplary embodiment may further provide a tapering surface on the J-shaped hook such that the vertical second leg tapers to the terminal upper end, wherein the tapering surface is located vertically above the upper surface of the projection. This exemplary embodiment or another exemplary embodiment may further provide that the channel formed in the front surface is defined by an upper surface of the channel, a lower surface of the channel, and an intermediate surface extending in the vertical direction between the upper surface and the lower surface. This exemplary embodiment or another exemplary embodiment may further provide that a height dimension of the channel is measured in the vertical direction between the upper surface of the channel and the lower surface of the channel, wherein the height dimension of the channel is greater than a height dimension of the protrusion. This exemplary embodiment or another exemplary embodiment may further provide that a width dimension of the channel is measured in the transverse direction between the intermediate surface of the channel and the front surface of the body, wherein the width dimension of the channel approximates a width dimension of the projection such that an intermediate surface of the projection on the identical second siding product contacts the intermediate surface of the channel when the siding product and the identical second siding product are connected together. This exemplary embodiment or another exemplary embodiment may further provide that the channel in the front surface of the body is parallel to an edge defining the top of the body. This exemplary embodiment or another exemplary embodiment may further provide that the channel in the front surface of the body is parallel to an edge defining the bottom of the body. This exemplary embodiment or another exemplary embodiment may further provide that the channel in the front surface of the body is positioned between the top and the bottom in an upper half of the front surface. This exemplary embodiment or another exemplary embodiment may further provide that the channel is located above the bottom of the body at approximately 80% of a total height dimension of the body. This exemplary embodiment or another exemplary embodiment may further provide that a height dimension, measured in the vertical direction, of the channel is greater than a height dimension of the projection. This exemplary embodiment or another exemplary embodiment may further provide that the height of the channel is approximately 150% greater than the height dimension of the projection.

In another aspect, an exemplary embodiment of the present disclosure may provide a method for a siding product assembly, the method comprising: installing a first siding product on a structure, wherein the first siding product defines a lateral channel in a frontal surface of the first siding product and wherein the lateral channel extends laterally between first and second ends of the first siding product; aligning and connecting a second siding product with the first siding product by inserting a laterally elongated projection on a rear of the second siding product into the lateral channel on the first siding product; temporarily supporting the second siding product via the connection of the projection and the channel, wherein the temporary support is adapted to prevent the second siding product from falling, bowing, and sagging prior to installation of the second siding product on the structure; and installing the second siding product on the structure. This exemplary embodiment or another exemplary embodiment may further provide that subsequent to installing the first siding product on the structure and prior to aligning and connecting the second siding product, the second siding product is subjected to gravitational forces that stress the second siding product along a length thereof, and the method further comprises: reducing stress in the second siding product imparted from gravitational forces along a length of the second siding response in response to inserting the projection into the channel. This exemplary embodiment or another exemplary embodiment may further provide that subsequent to installing the first siding product on the structure and prior to aligning and connecting the second siding product, the second siding product is subjected to a force that stresses, via a plane stress, the second siding product, and the method further comprises: aligning a maximum dimension of the projection on the second siding product perpendicular to the plane stress, wherein the plane stress is parallel to the force that stresses the second siding product; and reducing the plane stress from a higher first value to a lower second value in response to inserting the projection into the channel. This exemplary embodiment or another exemplary embodiment may further provide increasing rigidity along a lower portion of the second siding product in response to inserting the projection into the channel, wherein the increased rigidity is adapted prevent the second siding product from flexing prior to permanent installation on the structure. This exemplary embodiment or another exemplary embodiment may further provide preventing the second siding product from laterally and transversely bowing when the second siding product is temporarily supported via the connection of the projection and the channel on the first siding product. This exemplary embodiment or another exemplary embodiment may further provide stiffening a lower portion of the second siding product in response to inserting the projection into the channel, wherein the stiffness of the lower portion of the second siding product is adapted prevent the second siding product from flexing or bowing prior to permanent installation on the structure. This exemplary embodiment or another exemplary embodiment may further provide preventing the second siding product from falling when the second siding product is temporarily supported via the connection of the projection and the channel on the first siding product. This exemplary embodiment or another exemplary embodiment may further provide moving an upwardly opened connector on the rear surface of the second siding product downwardly in a vertical direction below a downwardly opened connector on the frontal surface of the first siding product, wherein the upwardly opened connector has a lower first leg and a vertical second leg that terminates in a terminal upper end, and wherein the projection extends rearward in the transverse direction from the vertical second leg of the upwardly opened connector; and wherein the downwardly opened connector on the first siding product has an upper first leg a vertical second leg that terminates in a terminal lower end, and the downwardly opened connector is positioned vertically above the lateral channel in the front surface of the first siding product. This exemplary embodiment or another exemplary embodiment may further provide moving the terminal upper end of the upwardly opened connector on the second siding product rearward in the transverse direction below the terminal lower end of the downwardly opened connector on the first siding product. This exemplary embodiment or another exemplary embodiment may further provide interlocking the second siding product to the first siding product prior to installing the second siding product on the structure. This exemplary embodiment or another exemplary embodiment may further provide contacting the protrusion on the second siding product with the frontal surface; and lifting the second siding product upward in the vertical direction to place the protrusion into the lateral channel to interlock the second siding product with the first siding product. This exemplary embodiment or another exemplary embodiment may further provide moving an upper surface of the protrusion above a lower surface of the channel as the second siding product is lifted upward in the vertical direction. This exemplary embodiment or another exemplary embodiment may further provide moving an intermediate surface of the protrusion rearward in the transverse direction above the lower surface of the channel as the second siding product is interlocked with the first siding product. This exemplary embodiment or another exemplary embodiment may further provide contacting an intermediate surface of the protrusion with an intermediate surface of the channel when the second siding product is interlocked with the first siding product, wherein the intermediate surface of the protrusion extends in the vertical direction between an upper surface of the protrusion and the lower surface of the protrusion, and wherein the intermediate surface of the lateral channel extends in the vertical direction between an upper surface of the lateral channel and the lower surface of the lateral channel, and the intermediate surface of the lateral channel is located between the frontal surface of the first siding product and a rear surface of the first siding product. This exemplary embodiment or another exemplary embodiment may further provide establishing a space between the upper surface of the protrusion and the upper surface of the lateral channel when the intermediate surface of the protrusion contacts the intermediate surface of the lateral channel. This exemplary embodiment or another exemplary embodiment may further provide establishing a space between the lower surface of the protrusion and the lower surface of the lateral channel when the intermediate surface of the protrusion contacts the intermediate surface of the lateral channel. This exemplary embodiment or another exemplary embodiment may further provide contacting the terminal upper end of the hook on the second siding product with the first leg of the hook on the lip of the first siding product. This exemplary embodiment or another exemplary embodiment may further provide leveling a top edge of the second siding product while the protrusion is positioned in the lateral channel on the first siding product. This exemplary embodiment or another exemplary embodiment may further provide that leveling the top edge of the second siding product is accomplished by increasing or narrowing a space between a portion of the protrusion and a surface that defines a portion of the lateral channel.

In yet another aspect, another exemplary embodiment of the present disclosure may provide a siding product comprising: a body having a first end and a second end defining a lateral direction therebetween, a top and a bottom defining a vertical direction therebetween, and a front and a rear defining a transverse direction therebetween; a front surface of the body and a rear surface of the body that is opposite front surface; a tab defining the first end of the body; a vertically aligned side lip extending rearward from the rear surface of the body adjacent the second end of the body, wherein the side lip defines a vertically aligned channel; and wherein the tab is configured to mate with the vertically aligned channel formed in the rear surface of an identical second siding product when installed laterally end-to-end to form a row of a siding assembly for a structure.

In yet another aspect, another exemplary embodiment of the present disclosure may provide a siding assembly comprising: a first body configured as an elongated panel for siding a structure; a second body configured identical to the first body; a downwardly opened first connector on a frontal surface of the first body; a laterally aligned channel on the frontal surface of the first body; an upwardly opened second connector on a rear surface of the second body; a laterally aligned projection on the second connector; wherein the second body is configured to be connected to the first body by interlocking the second connector with the first connector, wherein the laterally aligned projection is within the laterally aligned channel when the second body is interlocked with the first body.

In yet another aspect, another exemplary embodiment of the present disclosure may provide a siding product that has a downwardly opened connector near an upper portion of a frontal face. There may be a channel below the downwardly opened connector. The siding product may also have an upwardly opened connector near a lower portion of a rear face. There may be a projection on the upwardly opened connector that interlocks or connects with the channel when the two connectors are connected together. The protrusion on one siding product and the channel on another siding product cooperate to prevent the top siding product from falling or distorting its shape prior to installation of the top siding piece on the structure.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
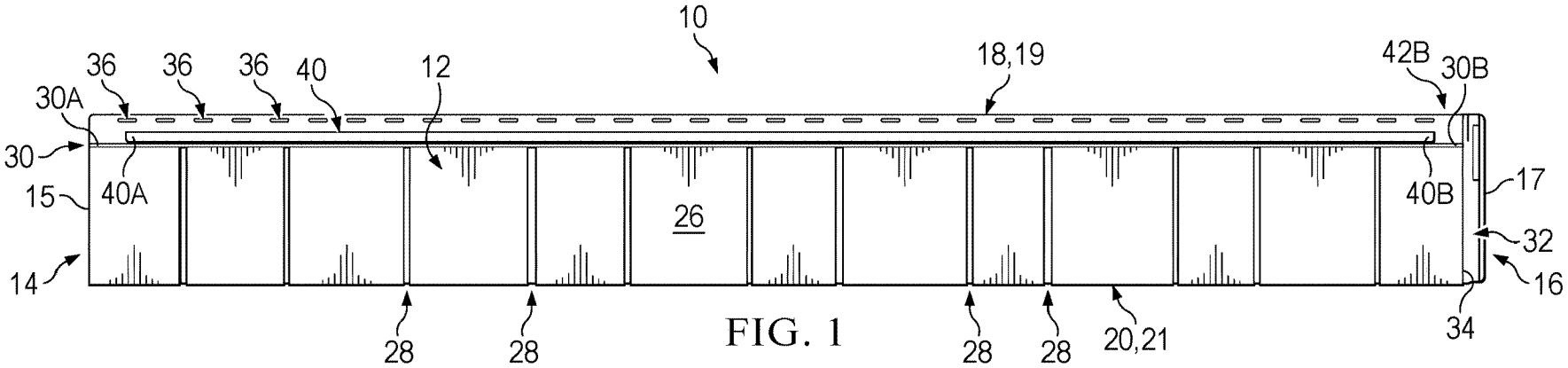
FIG. 1 (FIG. 1) is a front elevation view of a siding product according an exemplary embodiment of the present disclosure.

FIG. 1-FIG. 8 depict a siding product generally at 10. In one embodiment, the siding product 10 may be a vinyl or vinyl-based siding product and thus be generally referred to as vinyl siding or siding 10. However, the siding product 10 may be formed from other polymer or natural material unless otherwise stated. Siding product 10 includes a body 12 that is sized and shaped to be installed on a home or other structure, preferably on the exterior of the structure, however the siding product could be installed on an interior wall of the structure if desired by the end user.

The body 12 may be a unibody that is either integrally molded, extruded, printed, or additively manufactured, removably machined, or otherwise formed as a unitary, monolithic member substantially fabricated from a natural or manmade, material. The material may be slightly flexible as one familiar with siding products would understand. In one example, a vinyl material, may form a substantial majority of the components or elements used to fabricate the body 12 and the various components integrally formed, molded, or extruded therewith. The body 12 should withstand typical environmental factors when installed on the exterior of a structure, such as wind, rain, snow, ice, or the like, without significantly damaging the body 12. While it is contemplated that the tool body and its additional components described herein are uniformly and integrally extruded, molded, or formed, it is entirely possible that the components of the tool body be formed separately from alternative materials as one having routine skill in the art would understand. Furthermore, while the components of the body 12 are discussed below individually, it is to be clearly understood that the components and their corresponding reference elements of the body 12 are portions, regions, pieces, or surfaces of the body 12 and all form a respective element or component of the unitary body 12. Thus, while the components may be discussed individually and identified relative to other elements or components of the body 12, in this exemplary embodiment, there is a single body 12 having the below described portions, regions, pieces or surfaces.

The body 12 of the siding product 10 may have a first end 14 and a second end 16 that define a lateral direction therebetween. There is a top 18 defined by edge 19 and a bottom 20 defined by edge 21 that define a vertical direction therebetween. There is a front 22 and a rear 24 that define a transverse direction therebetween. The directions are orthogonal to each other, similar to cardinal coordinates. The length of the body 12 is aligned in the lateral direction. The width or thickness of the body 12 is aligned in the transverse direction. The height of the body 12 is aligned in the vertical direction. In one embodiment, the length of body 12 is the maximum dimension of siding product 10 such that the length is greater than the width and the height. However, it is possible to have shorter segments of the body 12 that may be cut to size by the installer of siding product 10 that could result in the length being less than the height. Typically, the width or thickness of the body 12 will be the minimum dimension relative to the other dimensions such that the thickness of the body 12 is less than the length and the height of the body 12.

FIG. 1 depicts that the front 22 of the body 12 defines a frontal surface 26 that is bound by an edge 15 defining the first end 14, an edge 17 defining the second end 16, edge 19 defining the top 18 and edge 21 defining the bottom 20. The frontal surface 26 is generally rectangular in configuration and may have ornamental features that generally resemble shingles or slats. However, it is entirely possible for the frontal surface 26 to be substantially flat or texturized in some other aesthetically pleasing way that would be desirable for an end user purchasing the siding product 10 for installation on a home or structure. For example, there may be a plurality of vertically aligned channels 28 formed in the frontal surface that are spaced apart at regular, semiregular, or random intervals to provide an appearance of shingles between respective channels 28. The channels extend upwardly from the edge 21 defining the bottom 20 and terminate at respective upper ends short of or vertically below the edge 19 defining the top 18. In one particular embodiment, the vertical channels 28 that are utilized for ornamental purposes terminate at an upper end that is commensurate with a laterally aligned channel 30. Laterally aligned channel 30 is not used for aesthetic purposes like the vertical channels 28. Rather, as will be detailed further herein, the laterally aligned channel 30 is utilized in a structural or constructive manner to assemble multiple pieces of the siding product 10 as an assembly 100 (see FIG. 8) when installed on a structure.

Channel 30 has a first end 30A and a 30B. The first end 30A is commensurate or coplanar with the edge 15 that defines the first end 14. In one particular embodiment, the first end 30A of channel 30 is orthogonal to the edge 15 that defines the first end 14, wherein the edge 15 that defines the first end 14 extends fully between top 18 and bottom 20. The second end 30B of channel 30 is adjacent the second end 16. However, second end 30B does not extend fully to the edge 17 that defines second end 16. As shown, a projection or tab 32 extends laterally outward between the top 18 and the bottom 20 of body 12. The second end 30B of channel 30 is commensurate with an inner vertical edge 34 of tab 32. The vertical edge 34 is closely adjacent the second end 16 but is offset toward the first end 14 and parallel to edge 17. The tab 32 is sloped front to back relative to the transverse direction which will allow the tab to slide behind the first end of an adjacent body 12 of another siding product 10 when multiple siding products are aligned end to end in the lateral direction as assembly 100. In one embodiment, channel 30 extends fully between the first end 14 and edge 34 in a manner that is parallel to the edge 21 defining the bottom 20 and parallel the edge 19 defining the top 18. In another embodiment, channel 30 is only parallel to bottom edge 21. However, channel 30 is offset closer to the edge 19 that defines the top 18 than the bottom 20. In one particular embodiment, the channel 30 extends laterally across the frontal surface 26 of the body 12 at a height that is approximately 80% of the overall height of body 12. For example, if the body 12 has a height of about ten inches, then the channel 30 extends laterally between first end 30A and second end 30B approximately eight inches above bottom 20 and approximately two inches below the top 18. In that regard, the vertical length of the vertical channels 28 that are designed for aesthetic purposes would have a height oriented in the vertical direct that is commensurate with approximately 80% of the overall height of the body 12. In another exemplary embodiment, the lateral channel 30 may be formed in the frontal surface and positioned at a height that greater than 50% of the overall height of the body 12.

The inclusion of channel 30 can be considered to delineate between an upper portion 26A of the frontal surface 26 and a lower portion 26B of the frontal surface 26. When the siding product 10 is assemble as part of a siding assembly 100, the upper portion 26A will be covered by an adjacent vinyl siding product that is located vertically above the shown siding product 10 and as will be described in greater detail herein. The upper portion 26A of the frontal surface 26 may define a plurality of through holes or through apertures 36 that extend fully through the body 12 of siding product from the frontal surface 26 to the rear surface 38. The apertures 36 are elongated oval apertures or rounded rectangular apertures that are spaced apart at regular or semiregular intervals. Apertures 36 may be used to receive a nail, screw or other connector therethrough to attach body 12 to the structure. The apertures 36 and the connector will be covered and not viewable when assembly 100 is constructed.

With continued reference to the upper portion 26A of the frontal surface 26, vertically between the apertures 36 and the channel 30 there is a lip 40. The lip 40 may also be referred to generally as a downwardly opened first connector. Stated otherwise, lip 40 is located vertically above channel 30 and vertically below apertures 36 on the upper portion 26A of the front surface 26. Lip 40 includes a first end 40A and a second end 40B. The first end 40A of lip 40 is spaced from the edge 15 defining the first end 14 and is located offset toward the second end 16. Thus, there is a space or region 42A on the upper portion 26A between the first end 40A and the second edge that defines first end 14. Similarly, the second end 40B of the lip 40 terminates short of the edge 34 of tab 32 to define a region 42B on the upper portion 26A of the frontal surface. Stated otherwise, the lip 40 extends in the lateral direction a significant portion or majority of the overall length of the body but does not fully extend end-to-end.

Figure 6A:
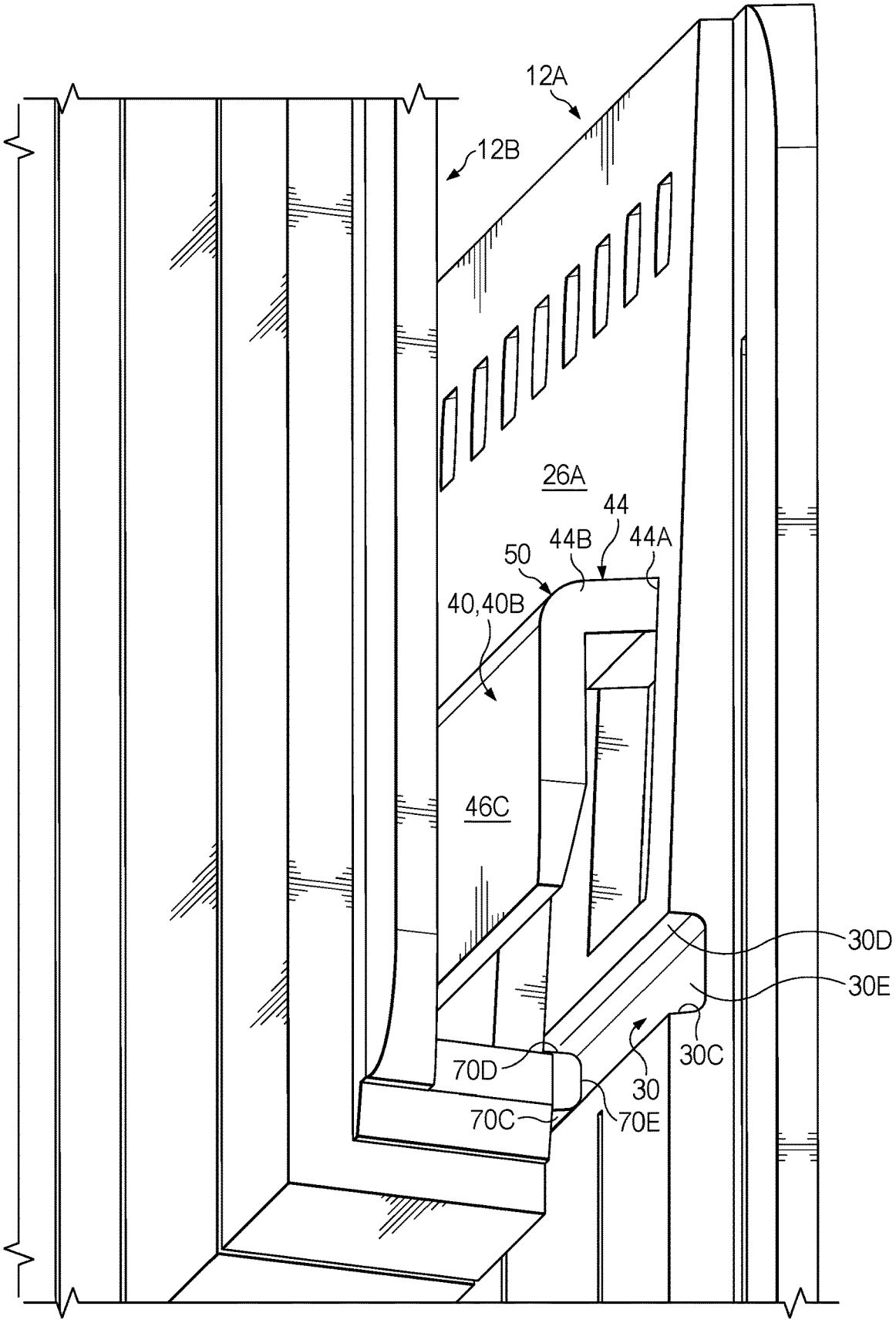
FIG. 6A (FIG. 6A) is side perspective view detailing the connection of the first siding product and the second siding product.
Figure 6B:
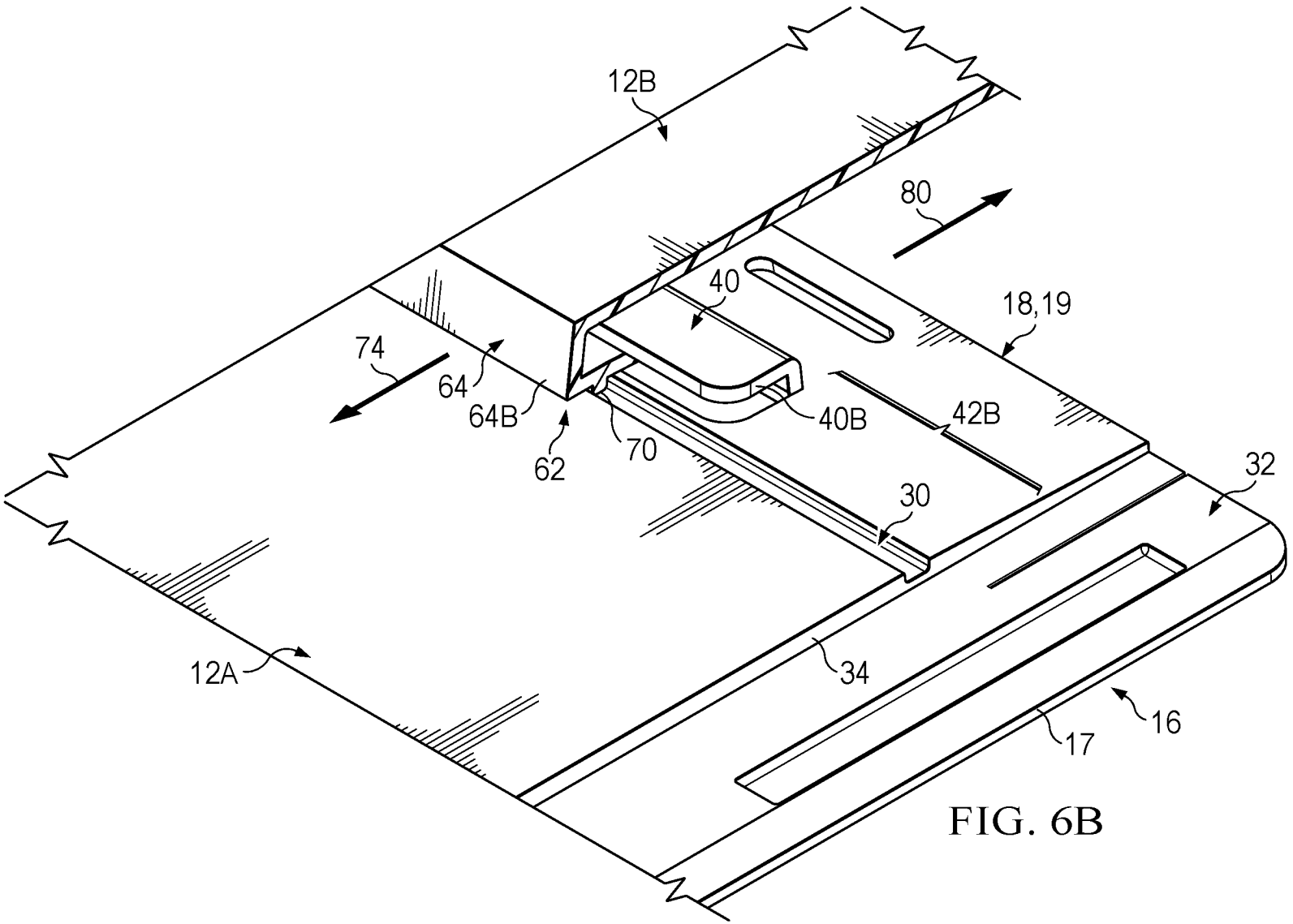
FIG. 6B (FIG. 6B) is another side perspective view detailing the connection of the first siding product and the second siding product, with the second siding product shown in cross section.
Figure 7:
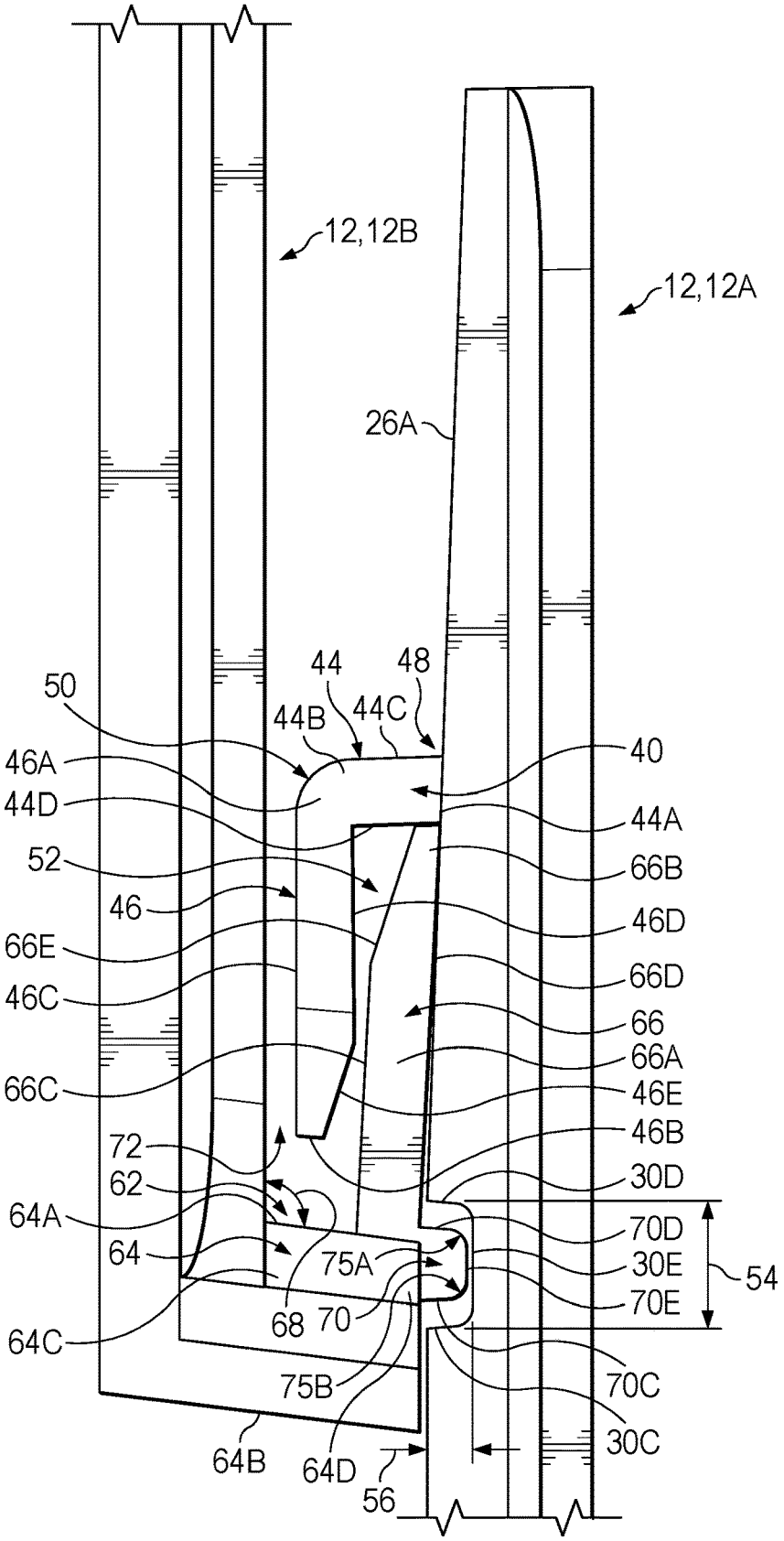
FIG. 7 (FIG. 7) is side elevation view detailing the connection of the first siding product and the second siding product.

As best seen in FIG. 6A and FIG. 7, lip 40 is generally shaped in an inverted L-shaped configuration. The inverted L-shaped configuration of lip 40 defines a downwardly faced opening to a channel or space 52 between lip 40 and frontal surface 26. Lip 40 includes a shorter upper first leg 44 and a longer vertical second leg 46. Leg 44 includes a first end 44A that is rigidly connected with the upper portion 26A of the frontal surface 26 of body 12. Leg 44 extends outwardly in the transverse direction from the front to a second end 44B of first leg 44. Second end 44B of leg 44 is spaced apart and positioned forwardly from frontal surface 26. Leg 44 includes an upper surface 44C and a lower surface 44D. The upper surface 44C meets the upper portion 26A at a rounded fillet or a corner 48. The upper surface 44C of leg 44 transitions over a convex corner 50 to join an upper end 46A of the second leg 46. Second leg 46 extends vertically downward to a lower terminal second end 46B. The terminal second end 46B, which is the lower most portion of lip 40, is positioned vertically above or higher than the lateral channel 30. Second leg 46 includes a forward or front surface 46C and a rear surface 46D. The rear surface 46D faces the upper portion 26A of frontal surface 26. The frontal surface 46C of the leg 46 faces the same direction as the frontal surface 26. The second leg 46 tapers or narrows as it approaches the terminal second end 46B. Namely, a tapered surface 46E is part of the rear surface 46D of the second leg 46. The tapering surface 46E extends between the vertical portion of rear surface 46D and the terminal second end 46B. In one particular embodiment, the tapering effect of the tapered surface 46E tapers from the rear surface 46D towards the frontal surface 46C. This allows the space 52 between the lip 40 and the upper portion 26A of the front surface 26 to narrow in the vertical direction. This tapering surface 46E works in conjunction with a hook 62, as will be described in greater detail below to allow one of the legs of the hook 62 to fit within the space 52 defined between the lip 40 and the upper portion 26A of the frontal surface 26. More particularly, space 52 is defined between the upper portion 26A of the frontal surface 26, the lower surface 44D of the first leg 44, the rear surface 46D of the second leg 46, and the tapering surface 46E of the second leg 46.

The lateral channel 30 is defined by a lower transverse wall 30C, an upper transverse wall 30D, and an intermediate vertical wall 30E. Collectively, the upper and lower transverse walls 30D, 30C and the intermediate vertical wall 30E define a C-shaped channel configuration of the lateral channel 30 when viewed in cross section. A vertical height of the channel 54 extends between the lower transverse wall 30 and the upper transverse wall 32. The depth of the channel is measured in the transverse direction as defined by a depth dimension 56. The depth dimension 56 of the lateral channel 30 is less than the overall width of thickness of the body 12 or the siding product 10. In one particular embodiment, the depth dimension 56 is about 10% to about 15% of the value of the width dimension of the body 12. So for example, if the width dimension or thickness of the body 12 is about 0.05 inch thick, then depth dimension 56 of the later channel 30E would range from 0.005 inch to about 0.025 inch. Because the lateral channel 30 is formed in the frontal surface 26 of the body 12, the intermediate vertical wall 30E of the lateral channel 30 is located between the frontal surface 26 and the rear surface 38 of body 12.

Figure 3:
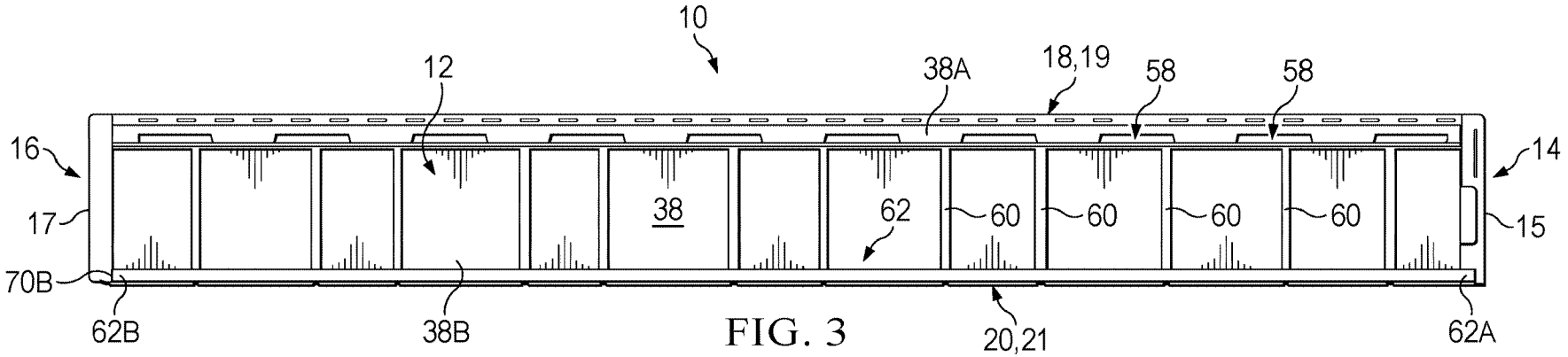
FIG. 3 (FIG. 3) is a rear elevation view of the siding product according the exemplary embodiment of the present disclosure.
Figure 2:
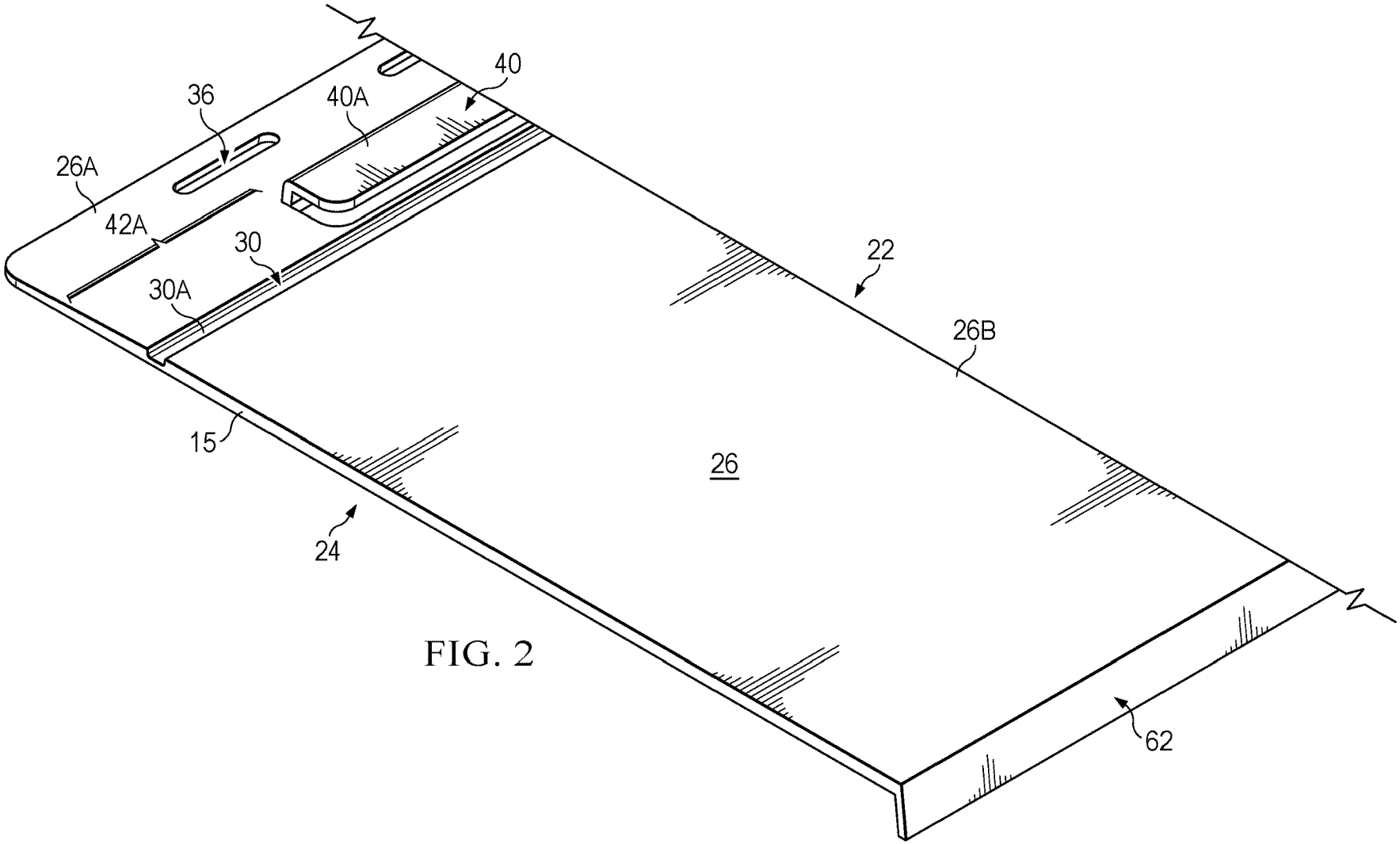
FIG. 2 (FIG. 2) is an enlarged front first end isometric view of the siding product.
Figure 4:
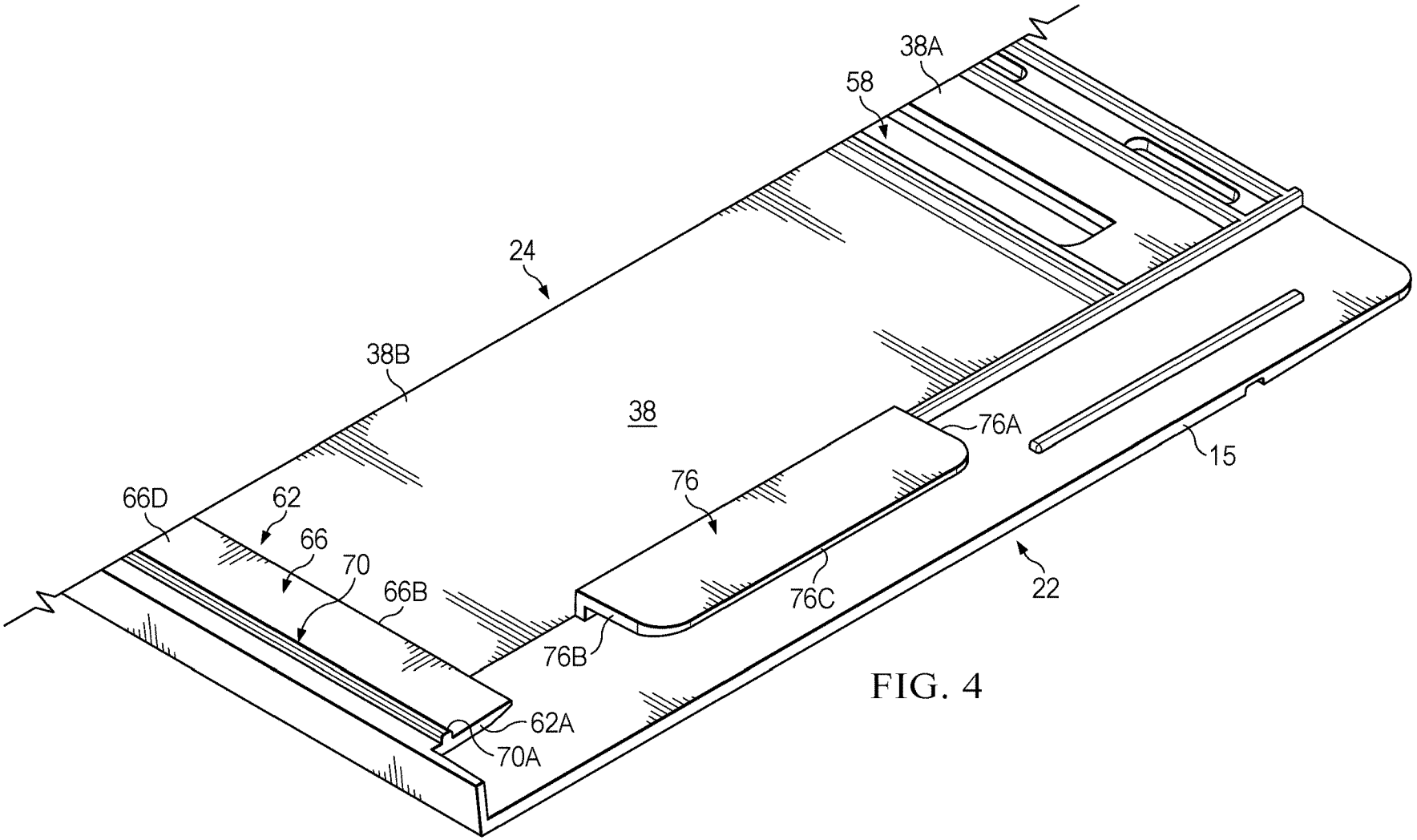
FIG. 4 (FIG. 4) is an enlarged rear first end isometric view of the siding product.
Figure 5:
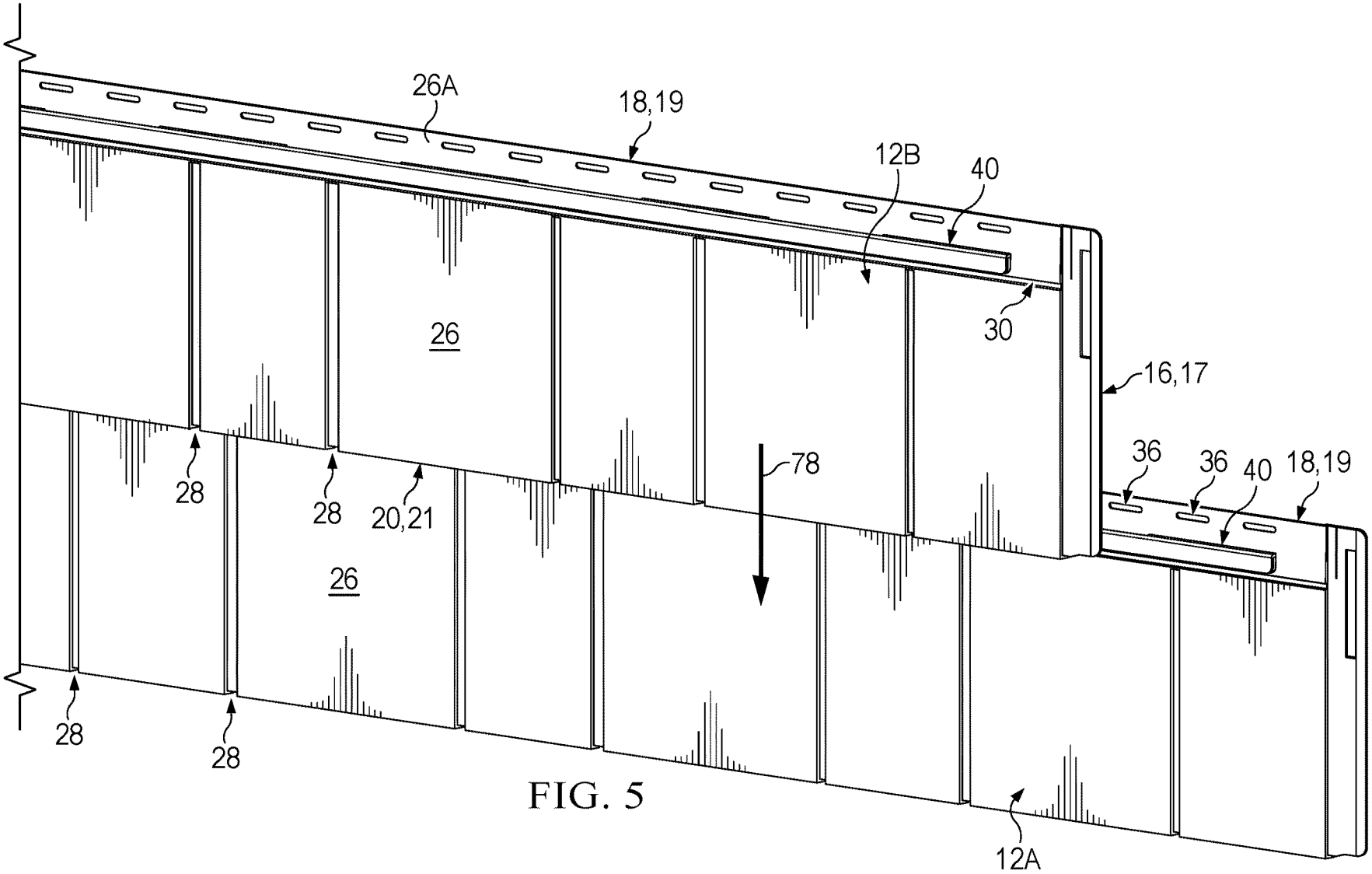
FIG. 5 (FIG. 5) is an operational front perspective view of a second siding product having been lowered and connected with a first siding product.

FIG. 3 and FIG. 4 depict the rear 24 of the body 12 of siding product 10. The rear surface 38 of body 10 may include an upper portion 38A and lower portion 38B that is delineated as the region above where the lateral channel 30 on the frontal surface 26 is located. Within the upper portion 38A of the rear surface 38, there are a plurality of slots 58 that extend through the body 12 in the transverse direction. Slots 58 are rectangular slots having a length oriented in the lateral direction. Each of the slots 58 has a length that is longer than the laterally aligned length of apertures 36. Slots 58 are located below apertures 36 and above lateral channel 30. Rear surface 38 may further include support ribs 60 that are vertically aligned and located at the same portions of the body 12 as the vertical channels 28 formed in the frontal surface 26.

The lower portion 38B of the rear surface 38 terminates at a hook 62. The hook 62 generally be considered to be a J-shaped hook. However, other letter-shaped or other configurations of a hook are possible. J-shaped hook 62 includes a first leg which is defined by the wall of body 12, a bottom or lower leg 64 and a vertical leg 66. Lower leg 64 includes an upper surface 64A and a lower surface 64B that defines the bottom 20 of body 12. Lower leg 64 includes a front end 64C and a rear end 64D. The front end 64C is connected at the lowermost portion of the lower portion 38B of the rear surface 38. In one embodiment, the angle 68 defined between the upper surface 64A and the rear surface 38 of body 12 is greater than 90 degrees but less than about 120 degrees. There may be some criticality in this range to provide a slightly obtuse angle 68 in order to effectuate alignment and a snap fitting relationship of a first siding product 12A with a second siding product 12B.

For example, as will be discussed in greater detail herein, there may be a first siding product 10 having a body 12A that is designed and configured to interlock with the second siding product having a body 12B. More particularly, the J-shaped hook 62 at or near the bottom 20 of the second body 12B is configured to connect with the lip 40 the front surface 26 of the first body 12A of the second siding product 10. The lip 40 and the J-shaped hook 62 cooperate to allow the two bodies 12A, 12B to interlock together. One notable feature of this configuration is that the second body 12B is vertically above the first body 12A when assembly 100 is assembled. The J-shaped hook 62 is upwardly opened while the lip 40 is downwardly opened. This may seem counter intuitive and would cause the two bodies 12A, 12B to not be able to connect together because one may think that gravity or a gravitational force, represented by Arrow 74 (see FIG. 6B), would simply cause the second body 12B to fall and not connect with lip 40 since it is downwardly opened and located above hook 62 which is upwardly opened. State otherwise, there is an upwardly opened connector on the lower portion of the rear surface of the body 12 and a downwardly opened connector on the upper portion of the front surface of body 12. However, to prevent the bodies 12A, 12B from being disconnected or to prevent the second body 12B from falling when the first body 12A is installed on a surface of the structure, the siding product utilizes an additional component or element to maintain the interlocking relationship of these two connectors (i.e., lip 40 and hook 62). More particularly and in accordance one specific an aspect of the present disclosure, the J-shaped hook 62 includes a boss or projection 70 that extends rearward from a rear surface 66D on the vertical leg 66 of the J-shaped hook 62. The projection or boss 70 fits within lateral channel 30 when body 12A is connected to body 12B.

The connection of the projection or boss 70 within the lateral channel 30 assists to prevent or inhibit the likelihood of the panels from falling and becoming disconnected. More particularly, the projection or boss 70 and the corresponding lateral channel 30 on an adjacent body allows or prevent two panels or bodies 12A, 12B from being disconnected before the installers secured the respective panel bodies or siding products 10 with a nail, screw, or other fastener.

Vertical leg 66 extends vertically upward from the upper surface 64A of the lower leg 64. Vertical leg 66 includes a lower end 66A, an upper end 66B, which is a terminal upper end 66B, a forward facing surface 66C and a rear surface 66D. The J-shaped hook 62 defines a channel 72 between the rear surface 38 of the lower portion 38B, the upper surface 64A of the lower leg 64, and the forward surface 66C of the vertical leg 66. The terminal upper end 66B may be defined by a tapering surface 66E that tapers from the forward surface 66C to the rear surface 66D. the thickness dimension of the vertical leg 66 should be less than that of the space 52 between the lip 40 and the front surface or upper portion 26A of the front surface 26 on an adjacent body 12 of a siding product 10.

Near the lower end 66A of the vertical leg 66, on the rear surface 66D thereof, the projection or boss 70 extends rearward in the transverse direction. The boss or projection 70 has a first end 70A and a second end 70B. The first end 70A is collocated with the first end 62A of the J-shaped hook 62 and the second end 70B of the projection 70 is collocated with the second end 62B of the j-shaped hook 62. Thus, the boss or projection 70A is a laterally elongated projection from the rear surface 66D of the J-shaped hook 62, and more particularly the vertical leg 66. Projection 70 may take the configuration of a rounded rectangle that is elongated in the later direction. Stated otherwise, projection 70 may have a lower wall 70C, and upper wall 70D and an intermediate wall 70E. The upper corner where the intermediate wall 70E meet the upper wall 70D may be rounded. Additionally, the lower corner where the intermediate wall 70E meets the lower wall 70C may be rounded. In one particular embodiment, these two rounded corners may have the same radius of curvature however; it is entirely possible for them to have radiuses of curvature or from them not to be rounded and to be squared corners. The shape and configuration of the boss or projection 70 may have some criticality to some embodiments of the present disclosure. Particularly, the vertical dimension of the projection or boss 70 may be slightly less than the height or height dimension 54 of the lateral channel 30. This allows the projection 70 to fit within the channel when two bodies 12A, 12B of a siding product 10 are assembled together as shown in FIG. 7. With the height dimension of the projection 70 being slightly less than that of height dimension 54, there is a slight space above the upper surface 70D of the projection and below the upper surface 30D of the channel 30. Additionally, there is a slight space or gap between the lower surface 70E of the projection 70 and above the lower surface 30C of channel 30. When two adjacent bodies 12A, 12B are connected the intermediate wall 70E of the projection 70 mates and contacts the intermediate wall 30E of channel 30. In one embodiment, the height dimension 54 of the channel is approximately 150% greater than the height dimension of the projection 70. In another embodiment, the height dimension 54 of the channel is approximately equal to the height dimension of the projection 70, which would allow for a tight snap-fit connection or mating relationship between projection 70 and channel 30 to thereby effectively eliminate the space between surfaces 30C, 70C and between surfaces 30D, 70D.

With primary reference to FIG. 4, there is a side connector or side lip 76 that assists with the connection of the first side 14 of body 12 with another body that is laterally adjacent body 12. The side lip 76 assists with the connection of the first side 14 of body 12 with the second side 16 of a laterally adjacent body. More particularly, the side lip 76 is elongated in the vertical direction and is projected rearward from the rear surface 38 in the lower portion 38B thereof. The side lip 76 is L-shaped in cross section and defines a vertical slot that is configure to receive tab 32 on the laterally adjacent body. Due to the placement of side lip 76, the first end 62A of hook 62 does not extend fully to the first side 14 of body 12. Rather, the first end 62A of hook 62 terminates short of the first end 14 and defines a space between the first end 62A of hook 62 and the first end 14 of body 12. Side lip 76 includes an upper end 76A and a lower end 76B, wherein the lower end 76B is aligned vertically directly below the upper end 76A. There is an intermediate vertical edge 76C extending between the upper end 76A and the lower end 76B. The intermediate vertical edge 76C is offset from edge 17 and not coplanar therewith such that the terminal end of side lip 76 (i.e., the intermediate vertical edge 76C) is tucked or positioned behind the body to mate with tab 32 on the adjacent body. The upper end 76A and the lower end 76B of the side lip 76 are vertically lower than the aperture 58. The upper end 76A and the lower end 76B of the side lip 76 are vertically higher than the hook 62.

As shown in FIG. 7, when the two bodies 12A, 12B of a siding product 10 are connected together in the manner shown, terminal upper end 66B of leg 66 of the J-shaped hook 62 contacts a right angle corner defined by the lower surface 44D of the first leg 44 on the lip 40. When the upper terminal end 66B is contacting the lower surface 44D of the lip 40, there may be a slight space or gap in the channel 30 above the upper surface 70D or projection 70. The height dimension 54 of the channel 30 allows some slight tolerance to allow the hook to move downward in the channel so as to close the gap between the lower surface 70C of projection 70 and the lower surface 30C of channel 30. However, these spaces may be eliminate such that projection 70 is completely complementary to the channel 30.

Having thus described the structural configurations of the siding product 10, reference will now be made to its operation, installation, and advantages utilizing the components detailed herein.

Figure 8:
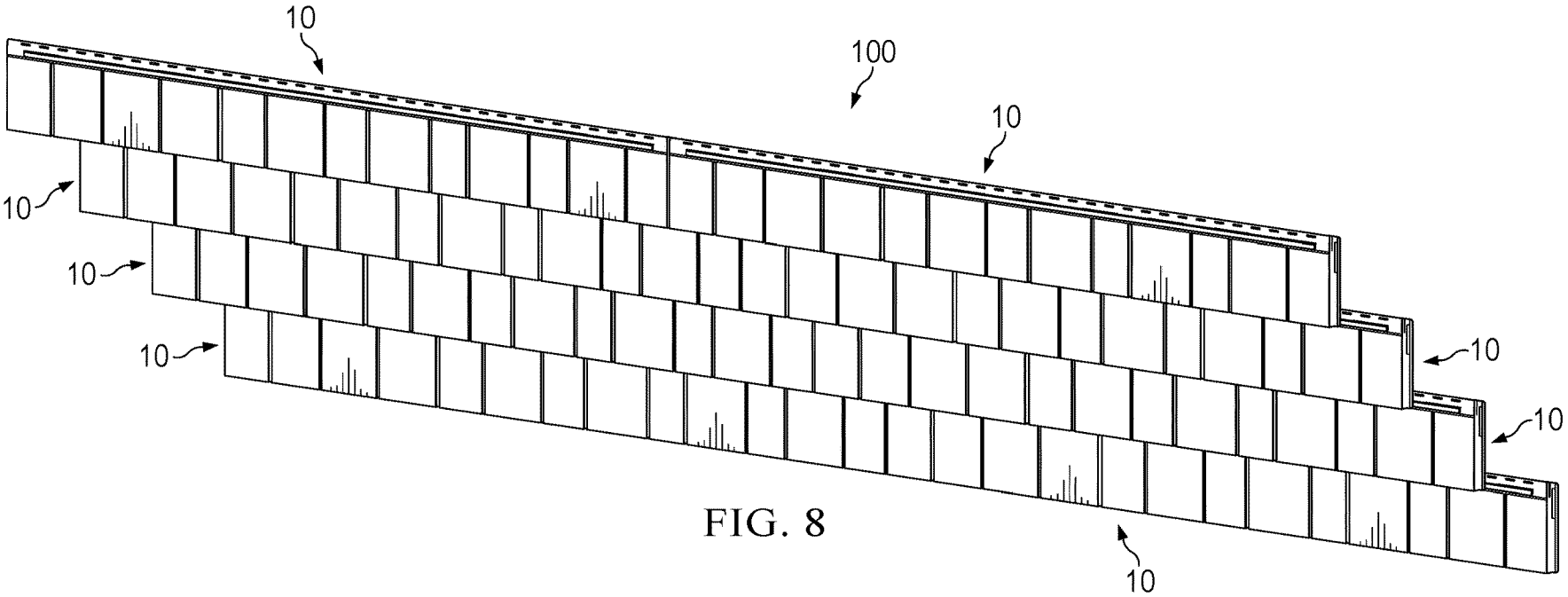
FIG. 8 (FIG. 8) is a front view of a siding assembly formed from a plurality of siding products having the configuration of the exemplary embodiment of the present disclosure.

In operation and with primary reference to FIG. 6-FIG. 8, the first body 12A of a siding product 10 is installed on a structure. In one particular embodiment, the first body 12A is aligned such that the top 18 and the bottom 20 are level. The top and bottom 18, 20 may be level to ground or level to the structure that the siding product is to be installed on.

The body 12A may be installed by connecting nails or other connectors through one or more of the apertures 36 located in the body such that the nails or connectors extend transversely through the apertures. In one example, nails or connectors may be hammered or otherwise driven through the apertures 36 adjacent the edge defining the top 18 of the body 12A. Then, once the body 12A is installed or otherwise connected to the support structure, a second body 12B may be lowered from above to align it near the top 18 of the first body 12A as indicated by arrow 78 in FIG. 5. More particularly, the bottom 20 of the second body 12B is lowered downwardly in the vertical direction as indicated by arrow 78. While lowering the body 12B downwardly in the vertical direction, the edge 21 defining the bottom 20 of the second body 12B is lowered past the edge 19 defining the top 18 of the first body 12A. A portion of the rear surface 38 on the second body 12B is positioned forwardly of a portion of the front surface 26 of the first body 12A. More particularly, the lower portion 38B of the lower surface 38 on the second body 12B is positioned forwardly from the upper portion 26A of the frontal surface 26 on the first body 12A.

The second body 12B is lowered to a point or location where the J-shaped hook 62 on the second body 12B is positioned vertically below the lip 40 on the front surface 26 of the first body 12A. Then, when the J-shaped hook 62 on the second body 12B is below the lip 40 on the first body 12A, the second body 12B is moved transversely toward the first body 12A. The movement of the second body 12B in the transverse direction towards the first body 12A closes the gap between the two respective bodies 12A, 12B. With the J-shaped hook 62 being positioned below the lip 40, and more particularly the upper terminal end 66B being vertically below the terminal lower end 46B, the rear surface 66D of the vertical leg 66 of the J-shaped hook 62 on the second body 12B is in close proximity with the frontal surface 26 of the first body 12A. Then, the second body 12B may be lifted in the vertical direction upward, as indicated by arrow 78 in FIG. 6B, to move the vertical leg 66 of the J-shaped hook 62 on the second body 12B into the space 52 between the lip 40 and the frontal surface 26 on the first body 12A. As the J-shaped hook is lifted upward in the vertical direction as indicated by arrow 80, the projection 70 on the second body 12B contacts and moves along the frontal surface 26 of the first body 12A. The second body 12B is continued to be lifted upward in the vertical direction until the projection snaps, or interlocks, or otherwise is positioned in the channel 30 formed in the frontal surface 26 of the first body 12A. When the projection 70 is positioned in the lateral channel 30, the projection 70 and channel 30 cooperate to prevent the J-shaped hook 62 on the second panel 12B that is mated or nested with the lip 40 on the first body 12A from falling and becoming disconnected before the installers secure the second body 12B with nails in a manner similar to that with which the first body 12A was installed on the structure (i.e., driving nails or screws through apertures 36). Stated otherwise, the projection 70 and the channel 30 mate together or nest together to allow these two features to interlock along the entire lateral length of projection 70 and channel 30 of the assembly or each respective body of each siding product 10.

As depicted in FIG. 7, when the projection 70 of the second body 12B is interlocked or otherwise nested or mated the channel 30 of the first body 12A, there is a slight gap or space between the upper surface 70D of projection 70 and the upper surface 30D of channel 30. Additionally, there is a slight space between the lower surface 70C of projection 70 and the lower surface 30C of channel 30. The space defined between the lower surface 70C and the lower surface 30C permits some tolerance to the interlocking relationship between the body 12A and the body 12B to allow the features to lock together but also for the second body 12B to be slightly adjusted and leveled in necessary. Similarly, slight space above the upper surface 70D of projection 70 and below the upper surface 30D of channel 30 assists with interlocking but as well as leveling the edge defining the top 18 of the second body 12B once the two bodies 12A, 12B are interlocked together.

In operational with respect to the projection 70, the rounded corner 75A between the upper surface 70D and the intermediate surface 70E has a first radius of curvature that is optimized to a size and dimension to allow the projection 70 to smoothly transition into the channel 30 as the second body 12B is lifted upward in the vertical direction in the manner described above. Similarly, the lower, or second rounded corner between the lower surface 70C and the intermediate wall 70E is a rounded corner 75B having a second radius of curvature to allow projection to smoothly transition into the channel 30 to interlock the two bodies 12A, 12B together. While it is envisioned that the first radius of curvature is associated with the first rounded corner 75A and the second radius of curvature is associated with the second rounded corner 75B would be equal in some embodiments to assist with the transition into the channel, it is entirely possible these radiuses of curvatures could be different and still assist with the transition into or out of (if desired) the channel 30. For example, if the second radius of curvature is smaller than the first radius of curvature, it may assist with the removal or adjustment of the second body 121B relative to the first boy 12*a* that is already installed on the structure. Thus, there may be some criticality to various different embodiments in which the radius of curvature of the respective rounded corners 75A, 75B is either the same or different.

With continued reference to the operative embodiments detailed herein, the first body 12A is first connected and installed on the structure. This enables the first body 12A to act as an anchor or fixed element. After the first body 12A of siding product 10 is installed on the support structure, an installer or builder (i.e., a person) will grasp the second body 12B and move it towards the first body 12A in the manner described above. Given that the body 12B is an elongated member, it is subjected to forces, such as gravitational forces 74 or other forces, when it is manipulated by the installer or builder. Since this thickness of the body 12 is relatively small and the body typically formed from vinyl (or consists essentially of vinyl or comprises vinyl), the body 12 is relatively flimsy or flexible. These forces cause a plane stress to be imparted to the second body 12B prior to it being connected to the first body 12A that can bend, bow, flex or distort shape of the body 12. The material, such as vinyl or other material, is under plane stress when a stress vector is zero across a particular plane over the body 12B. Plane stress typically occurs in thin flat plates that are acted upon only by forces that are parallel to them, such as when the installer or builder is holding the siding product 10 and trying to maneuver it into alignment with the other siding product(s) that are already installed on the structure. In these situations, the siding product 10 has a tendency to flex or bow and the plane stress is at a higher first value. The connection and/or insertion of projection 70 into channel 30 enables the reduction of the plane stress from the higher first value to a lower second value. This prevents the second siding product from flexing or bowing prior to permanent installation on the structure. Thus, the interlocking relationship utilizing projection 70 into channel 30 not only prevents the second body 12B from falling, it also reduces stresses on the body 12B during installation.

Additionally, the operation of creating assembly 100 provides for increasing rigidity along a lower portion of the body 12B of the second siding product in response to inserting the projection 70 into the channel 30 on body 12A. The increased rigidity is adapted prevent the second siding product from flexing prior to permanent installation on the structure. This exemplary method or process may also provide for preventing the body 12B of the second siding product from laterally and transversely bowing when the second siding product is temporarily supported via the connection of the projection 70 and the channel 30 on the body 12 A of the first siding product. Thus, there is effective stiffening of a lower portion of the second siding product in response to inserting the projection into the channel, wherein the stiffness of the lower portion of the second siding product is adapted prevent the second siding product from flexing or bowing prior to permanent installation on the structure. This also assists with preventing the second siding product from falling when the second siding product is temporarily supported via the connection of the projection and the channel on the first siding product.

In operational with respect to the side lip 76, the first body 12A is installed on the structure such that side lip 76 projects from the rear surface and faces the structure. A laterally adjacent body of another siding product is slid toward the first side 14 of body 12A. The tab 32 on the other body is slid laterally and disposed in the space defined between the side lip 76 and the rear surface 38 of body 12A. The side lip 76 interlocks with the tab 32 on the laterally adjacent body. More particularly, the laterally adjacent body is slid laterally until the edge 17 on the second end 16, defined by tab 32, is moved behind and rearward for first edge 14 on body 12A. The laterally adjacent body is continued to be slid laterally until the edge 17 comes to rest in the vertical slot defined by side lip 76. The tab 32 on the laterally adjacent body thereby interlocks with the slide lip 76 on body 12A.

Typically, siding product 10 is a simple extruded or molded unibody product that is otherwise free from other secondary components. However, alternative embodiments of a siding product may additionally include lights, LEDs to generate a design or otherwise produce a signal/alert mechanism, or one or more sensors to sense or gather data pertaining to the surrounding environment or operation of the siding product, assembly, or system. Some exemplary sensors capable of being electronically coupled with the siding product, assembly, or system of the present disclosure (either directly connected to the siding product, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

As described herein, aspects of the present disclosure may include one or more electrical or other similar secondary components and/or systems therein. The present disclosure is therefore contemplated and will be understood to include any necessary operational components thereof. For example, electrical components will be understood to include any suitable and necessary wiring, fuses, or the like for normal operation thereof. It will be further understood that any connections between various components not explicitly described herein may be made through any suitable means including mechanical fasteners, or more permanent attachment means, such as welding or the like.

Unless explicitly stated that a particular shape or configuration of a component is mandatory. Any of the elements, components, or structures discussed herein may take the form of any shape. Thus, although the figures depict the various elements, components or structures of the present disclosure according to one or more exemplary embodiments, it is to be understood that any other geometric configuration of that element, component or structure is entirely possible. For example, instead of the lateral channel 30 being C-shaped in cross section and the protrusion 70 being at least semi-complementary or fully complementary to the shape or configuration of the channel 30, the channel 30 and corresponding complementary protrusion 70 can take any shape that prevents the second siding product from falling, bowing, and sagging prior to permanent installation on the structure, or otherwise reduce stress in the second siding product imparted from forces along the length of the second siding response in response to inserting the projection into the channel. For example, the channel 30 and corresponding complementary protrusion 70 may have a cross sectional configuration that is semi-circular triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration. In this similar regard, although hook 62 has been described as J-shaped and lip 40 has been described as inverted L-shaped, they too may take on any time of hook and corresponding lip configuration that still permits the protrusion 70 to mate or nest with lateral channel 30.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A method for a siding product assembly, the method comprising:

installing a first siding product on a structure, wherein the first siding product defines a frontal surface, and the frontal surface thereof defines a lateral channel therein, the lateral channel defining a plurality of channel walls including a lower transverse channel wall and an upper transverse channel wall, wherein the first siding product includes a downwardly opened connector on the frontal surface thereof, the downwardly opened connector having an upper first leg and a vertical second leg, the vertical second leg terminating in a terminal lower end, and wherein the lateral channel extends laterally between first and second ends of the first siding product, both the lower transverse wall and the upper transverse wall of the lateral channel being spaced vertically below the terminal lower end of the vertical second leg;

aligning and connecting a second siding product with the first siding product by inserting a laterally elongated projection on a rear surface of the second siding product into the lateral channel on the first siding product;

temporarily supporting the second siding product via a connection of the projection and the channel, wherein the temporary support is adapted to prevent the second siding product from falling, bowing, and sagging prior to installation of the second siding product on the structure; and installing the second siding product on the structure.

2. The method of claim 1, wherein subsequent to installing the first siding product on the structure and prior to aligning and connecting the second siding product, the second siding product is subjected to a gravitational force that stress the second siding product along a length thereof, and the method further comprises:

reducing stress in the second siding product imparted from gravitational forces along a length of the second siding response in response to inserting the projection into the channel.

3. The method of claim 1, wherein subsequent to installing the first siding product on the structure and prior to aligning and connecting the second siding product, the second siding product is subjected to a force that stresses, via a plane stress, the second siding product, and the method further comprises:

aligning a maximum dimension of the projection on the second siding product perpendicular to the plane stress, wherein the plane stress is parallel to the force that stresses the second siding product; and reducing the plane stress from a higher first value to a lower second value in response to inserting the projection into the channel.

4. The method of claim 1, further comprising:

increasing rigidity along a lower portion of the second siding product in response to inserting the projection into the channel, wherein the increased rigidity is adapted prevent the second siding product from flexing prior to permanent installation on the structure.

5. The method of claim 1, further comprising:

preventing the second siding product from laterally and transversely bowing when the second siding product is temporarily supported via the connection of the projection on the second siding product and the channel on the first siding product.

6. The method of claim 1, further comprising:

stiffening a lower portion of the second siding product in response to inserting the projection into the channel, wherein the stiffness of the lower portion of the second siding product is adapted prevent the second siding product from flexing or bowing prior to permanent installation on the structure.

7. The method of claim 1, further comprising:

preventing the second siding product from falling when the second siding product is temporarily supported via the connection of the projection and the channel on the first siding product.

8. The method of claim 1, further comprising:

moving an upwardly opened connector on the rear surface of the second siding product downwardly in a vertical direction below the downwardly opened connector on the frontal surface of the first siding product, wherein the upwardly opened connector has a lower first leg and a vertical second leg that terminates in a terminal upper end, and wherein the projection extends rearward in a transverse direction from the vertical second leg of the upwardly opened connector.

9. The method of claim 8, further comprising:

moving the terminal upper end of the upwardly opened connector on the second siding product rearward in the transverse direction below the terminal lower end of the downwardly opened connector on the first siding product.

10. The method of claim 1, further comprising interlocking the second siding product to the first siding product prior to installing the second siding product on the structure.

11. The method of claim 10, further comprising:

contacting the protrusion on the second siding product with the frontal surface; and lifting the second siding product upward in the vertical direction to place the protrusion into the lateral channel to interlock the second siding product with the first siding product.

12. The method of claim 11, further comprising:

moving an upper surface of the protrusion above a lower surface of the channel as the second siding product is lifted upward in the vertical direction.

13. The method of claim 12, further comprising:

moving an intermediate surface of the protrusion rearward in a transverse direction above the lower surface of the channel as the second siding product is interlocked with the first siding product.

14. The method of claim 13, further comprising:

contacting an intermediate surface of the protrusion with an intermediate surface of the channel when the second siding product is interlocked with the first siding product, wherein the intermediate surface of the protrusion extends in the vertical direction between an upper surface of the protrusion and the lower surface of the protrusion, and wherein the intermediate surface of the lateral channel extends in the vertical direction between an upper surface of the lateral channel and the lower surface of the lateral channel, and the intermediate surface of the lateral channel is located between the frontal surface of the first siding product and a rear surface of the first siding product.

15. The method of claim 14, further comprising:

establishing a space between the upper surface of the protrusion and the upper surface of the lateral channel when the intermediate surface of the protrusion contacts the intermediate surface of the lateral channel.

16. The method of claim 14, further comprising:

establishing a space between the lower surface of the protrusion and the lower surface of the lateral channel when the intermediate surface of the protrusion contacts the intermediate surface of the lateral channel.

17. The method of claim 11, further comprising:

defining a hook on the second siding product and contacting the terminal upper end of the hook on the second siding product with the first leg of the hook on the lip of the first siding product.

18. The method of claim 11, further comprising:

leveling a top edge of the second siding product while the protrusion is positioned in the lateral channel on the first siding product.

19. The method of claim 18, wherein leveling the top edge of the second siding product is accomplished by increasing or narrowing a space between a portion of the protrusion and a surface that defines a portion of the lateral channel.

20. The method of claim 1, wherein the lateral channel further defines an intermediate vertical channel wall extending between the lower transverse channel wall and the upper transverse channel wall, the protrusion defining a lower protrusion wall, upper protrusion wall, and an intermediate protrusion wall, and wherein the intermediate protrusion wall of the protrusion contacts the intermediate vertical channel wall of the lateral channel upon connection of the protrusion with the lateral channel.

* * * * *